US008523307B2

(12) United States Patent
Chung et al.

(10) Patent No.: US 8,523,307 B2
(45) Date of Patent: Sep. 3, 2013

(54) PRINTING SYSTEM

(75) Inventors: Kwang Choon Chung, Yongin (KR); Hae Sung Jung, Ansan (KR); Ki Yong Kim, Gwangju (KR); Kyung Soo Kim, Siheung (KR); Sung Chul Jeon, Seoul (KR); Chung Il Kim, Suwon (KR)

(73) Assignee: Inktec Co., Ltd., Ansan (KR)

( * ) Notice: Subject to any disclaimer, the term of this patent is extended or adjusted under 35 U.S.C. 154(b) by 5 days.

(21) Appl. No.: 13/123,963

(22) PCT Filed: Oct. 14, 2009

(86) PCT No.: PCT/KR2009/005917

§ 371 (c)(1),
(2), (4) Date: Apr. 13, 2011

(87) PCT Pub. No.: WO2010/044608

PCT Pub. Date: Apr. 22, 2010

(65) Prior Publication Data

US 2011/0205266 A1 Aug. 25, 2011

(30) Foreign Application Priority Data

Oct. 14, 2008 (KR) ..... 10-2008-0100879

(51) Int. Cl.
*B41J 29/38* (2006.01)

(52) U.S. Cl.
USPC ..... 347/6; 347/5

(58) Field of Classification Search
None
See application file for complete search history.

(56) References Cited

U.S. PATENT DOCUMENTS

| | | | | |
|---|---|---|---|---|
| 6,345,878 | B1 * | 2/2002 | Kanaya | 347/23 |
| 8,033,624 | B2 * | 10/2011 | Silva et al. | 347/4 |
| 2006/0192822 | A1 | 8/2006 | Usuda et al. | |
| 2008/0012919 | A1 * | 1/2008 | Sugahara | 347/102 |
| 2008/0238979 | A1 | 10/2008 | Umeda | |

FOREIGN PATENT DOCUMENTS

| | | | |
|---|---|---|---|
| JP | 2006-231898 | A | 9/2006 |
| JP | 2008-207560 | A | 9/2008 |
| JP | 2008-238695 | A | 10/2008 |

* cited by examiner

*Primary Examiner* — Geoffrey Mruk
(74) *Attorney, Agent, or Firm* — Birch, Stewart, Kolasch & Birch, LLP

(57) ABSTRACT

A printing system including a computer device and an ink jet printer transmitting and receiving data with the computer device is disclosed. The large size ink jet printer includes a printer; an ink pump; a head controller controlling the operation of the printer head; a carriage with the printer head; a carriage driving part; a data path board receiving and analyzing the data and transferring a control signal to the head controller; an ink supply control board the ink pump; and an I/O controller board receiving the data from the computer device, the data path board and the ink supply control board and analyzing and transmitting the data, and the computer device including a RIP program converting an image/text signal into an image/text raster image data for printing; and a carriage driving part control program controlling the operation of the carriage driving part of the ink jet printer.

5 Claims, 2 Drawing Sheets

PRINTING SYSTEM

TECHNICAL FIELD

The present invention relates to a large size ink jet printer, and in particular to a printing system of a printer which is mainly used for the purpose of industry.

BACKGROUND ART

An ink jet printer represents a printer which is basically designed to print as ink is injected via a head nozzle with the aid of a controlled operation of a printer head.

Almost small size ink jet printers, which are widely used at home or office, generally use standard size white papers and use a black ink (K) and three color inks (C, M and Y) for a color printing.

The industrial ink jet printer generally uses paper sheets as well as various printing object such as cloth, synthetic resin, glass, etc. and is widely used in the industry because it is good at printing a large size printing object. The industrial ink jet printer various inks for expressing colors depending on the characteristics, environment and purpose of a printing object as compared to a small size home ink jet printer and various solutions such as a primer solution and coating solution, a base ink (usually, white ink) are injected in an ink jet method, along with a washing function of a nozzle part of a printer, etc. for managing an expensive equipment for efficiently managing the system.

The industrial ink jet printer in relation with ink flow paths comprises a big size main ink tank with a large volume for storing various color inks, and a small size reservoir ink tank which temporarily stores the inks from the main ink tank before the inks are injected to a printer head.

The term "main ink tank" has been used throughout the descriptions, but in the present invention it might represent a washing liquid tank for cleaning the reservoir ink tank and the printer head if necessary, or might represent a storing tank for storing a primer solution or a coating solution which are processed on a printing object before or after color printing or might represent an ink tank for storing a white ink which is used for a white color base before a color printing so as to prevent the distortion of colors which might occur after printing of a colored printing object. In the large size printer, a plurality of solution tanks for specific purposes in addition to the main ink tanks for four colors C, M, Y and K are generally used, and the inks of the main ink tanks are transferred to the printer head via each ink pump as compared to a small size printer.

The large size ink jet printer needs to control a plurality of ink tanks and pumps s compared to a small size ink jet printer connected from an ink cartridge to a printer head, and a lot of data are used for controlling the above elements.

The common small size printer converts the RGB data into the CMYK data for a printer output by using an ICC profile, and the head part recognizes the data and outputs.

In the large size printer, as compared to a small size printer, there is further provided a RIP (Raster Image Processor) for changing a vector image or text into a raster (bit map) image. The RIP is software for a printing as well as for obtaining a best quality printing in combination with a color setting, a change of output object, work management and other various functions. A lot of memory and data process are necessarily needed for the operation of the RIP. The large size printer needs a lot of data transmission as compared to the small size printer. A data pump system is used for a high speed image data transmission.

In case of a large size printer system, a printer head part is made in a very complicated structure, and a lot of data process capacity is needed for integrally controlling and managing the complicated structures.

The carriage with a printer head is very precisely controlled with the aid of a servo motor and is subject to a movement based on three-axes of X, Y and Z, for controlling which a lot of data processing capacities are needed.

The large size ink jet printer, which has been developed and commercially used in the industry, is manufactured by just upgrading a small size printer to a big size printer. Namely, in the course of a large size printer manufacture, various kinds of parts generally needing a lot of data process capacities, and modules are needed, but in the conventional art, such parts and modules are subjected at one side of either a computer device or a large size printer, according to which a memory overflow might occur while managing all the parts and modules and controlling the same. Since either a computer side or a large printer system controls each part and module, the processing capacities to become low, and a printing speed might become slow and a printing quality might be worse. An optimization of system is needed based on a manufacture spec, but such system optimization needs lots of cost and time.

DISCLOSURE OF INVENTION

Accordingly, it is an object of the present invention to provide a printing system which makes it possible to reduce a data process load and obtain a faster and efficient printing work in such a manner that a control system management, which has been handled by assigning on either a computer device or a large size printer, is properly distributed to a control module (board) which is separately provided.

To achieve the above objects, there is provided a printing system which is formed of a computer device and a large size ink jet printer transmitting and receiving a data with the computer device which comprises the large size ink jet printer including a printer head injecting an ink on a printing object which is to be printed; an ink pump supplying an ink to the printer head; a head controller controlling the operation of the printer head; a carriage with the printer head; a carriage driving part moving the carriage in at least one direction; a data path board receiving and analyzing the data from the computer device and transferring a control signal to the head controller for controlling the printer head; an ink supply control board controlling the operation of the ink pump; and an I/O (Input and Output) controller board receiving the data from the computer device, the data path board and the ink supply control board and analyzing and transmitting the data, and the computer device including a RIP (Raster Image Process) program converting an image/text signal into an image/text raster (bit map) image data for printing; and a carriage driving part control program controlling the operation of the carriage driving part of the large size ink jet printer.

The computer device further comprises a data pump interface which is provided at the computer device and transfers the data of the RIP program to the data transfer board; and a carriage driving part controller interface which is provided at the computer device and transfers a signal of the carriage driving part control program to the I/O controller board.

The large size ink jet printer comprises at least one main ink tank pumping ink with the aid of the ink pump; a level sensor detecting an ink level in the main ink tank and connected with the ink supply control board for transmitting and receiving data with the ink supply control board; at least reservoir ink tank into which the ink pumped from the main ink tank with the aid of the ink pump and which is connected with the printer head; and a reservoir ink tank level sensor detecting an ink level of the reservoir ink tank and connected with the data path board for transmitting and receiving data with the data path board.

The large size ink jet printer further comprises a pneumatic and negative pressure selection valve selectively applying either a pneumatic or negative pressure to the reservoir ink tank and connected with the data path board for transmitting and receiving data with the data path board.

The carriage driving part is connected with the I/O controller board for transmitting and receiving data with the I/O controller board, and the carriage driving part comprises a driving motor and a linear scale.

An ink injected from the printer head of the large size ink jet printer is a UV ink, and sad large size ink jet printer further comprises a UV lamp hardening the UV ink; and a UV lamp controller which controls the operation of the UV lamp and is connected with the I/O controller board for transmitting and receiving data with the I/O controller board.

The large size ink jet printer comprises a flat bed which supports a printing object, which will be printed, and has suction holes; a flat bed vacuum pump which applies a vacuum pressure to the flat bed and is connected with the I/O controller board for transmitting and receiving data with the I/O controller board; and a flat bed pressure sensor which detects a vacuum pneumatic pressure of the flat bed by the flat bed vacuum pump and is connected with the I/O controller board for transmitting and receiving data with the I/O controller board.

The large size ink jet printer comprises a first roll transferring a printing object in the course of printing; and a first roll driving motor which drives the first roll and is connected with the I/O controller board for transmitting and receiving data with the I/O controller board.

The large size ink jet printer comprises a second roll maintaining a certain tension of a printing object of the first roll; and a second roll driving motor which drives the second roll and is connected with the I/O controller board for transmitting and receiving data with the I/O controller board.

The ink pump is connected with the ink supply control board for transmitting and receiving data with the ink supply control board.

The head controller is connected with the data path board for transmitting and receiving data with the data path board.

ADVANTAGEOUS EFFECTS

In the present invention, a driving part, a head part, and an ink supply part are mounted on a board with a MCU as compared to the conventional art in which such driving part, head part and ink supply part are controlled by either a computer device or a large size printer system, and an I/O controller board is provided to integrally control the communications between the above elements, and the data of the I/O controller board are transferred to a computer device, and the information received from the computer device are transferred to each corresponding board and connection devices, thus decreasing data process load while achieving a faster and reliable printing work along with a more efficient printing operation.

BRIEF DESCRIPTION OF THE DRAWINGS

The present invention will become better understood with reference to the accompanying drawings which are given only by way of illustration and thus are not limitative of the present invention, wherein.

BRIEF DESCRIPTIONS OF REFERENCE NUMERALS OF MAJOR ELEMENTS OF THE DRAWINGS

| | |
|---|---|
| 100: PC | 110: data pump interface |
| 120: carriage driving part controller interface | 200: I/O controller board |
| 210: carriage driving part | 220: first roll driving motor |
| 230: second roll driving motor | 240: flat bed vacuum pump |
| 250: flat bed pressure sensor | 260: UV lamp controller |
| 300: data path board | 310: head controller |
| 320: reservoir ink tank level sensor | 330: pneumatic/negative pressure selection valve |
| 400: ink supply control board | 410: ink pump |
| 420: main ink tank level sensor | |

MODES FOR CARRYING OUT THE INVENTION

The preferred embodiments of the present invention will be described with reference to the accompanying drawings. The examples of the drawings are not limited thereto.

Figure 1:
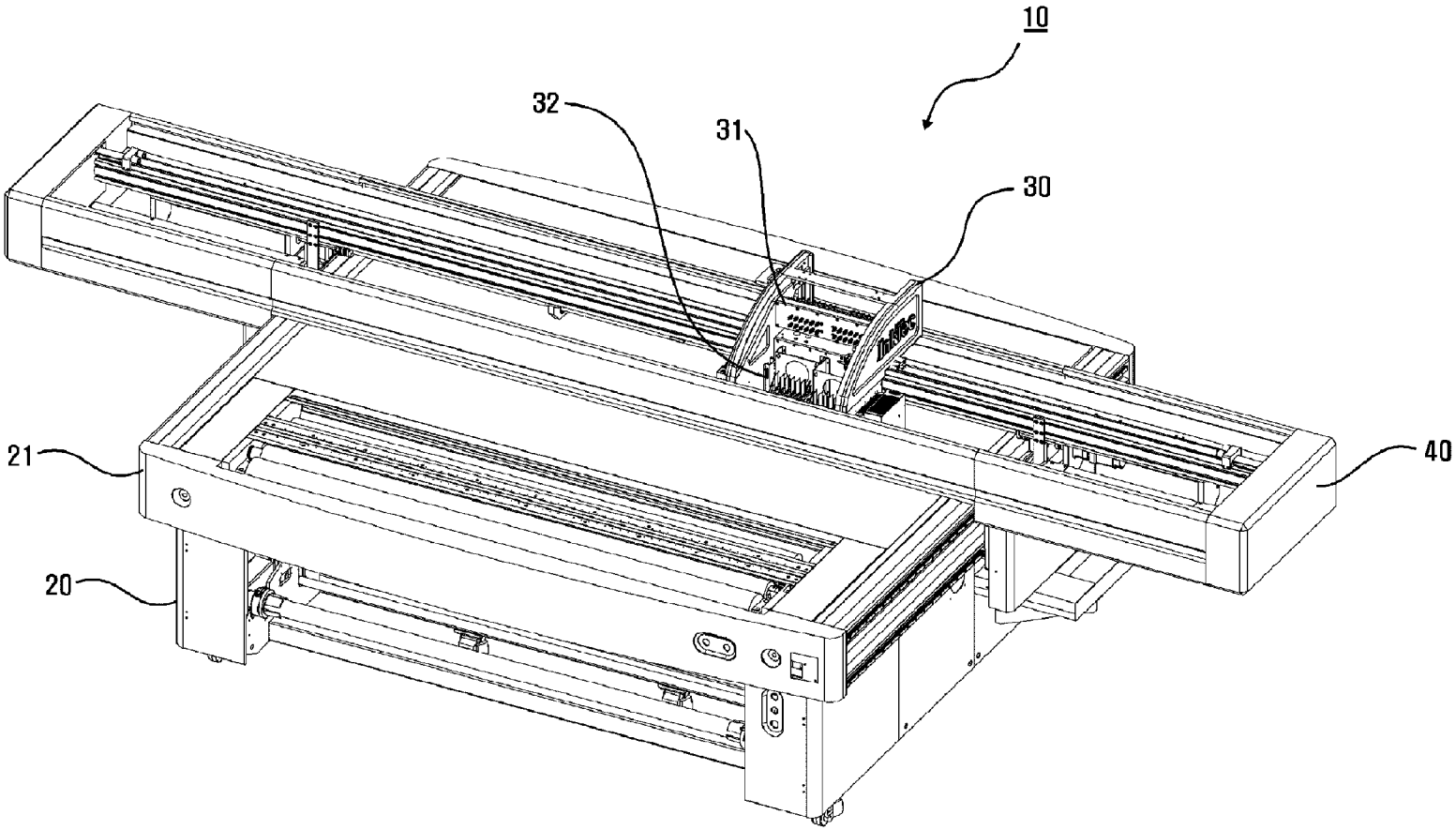
FIG. 1 is a perspective view illustrating a large size ink jet printer according to the present invention.

As shown in FIG. 1, the large size ink jet printer 10 is an industrial ink jet printer and comprises a printer body 20, a carriage 30 which is movable along an upper side of the printer body 20, and a carriage guide 40 for guiding the movement of the carriage 30.

The carriage 30 comprises an ink jet printing motor 30 and a reservoir ink tank unit 32 connected with the ink jet printing module 31.

The reservoir ink tank unit 32 comprises a reservoir ink tank (not shown) and a printer head (not shown) connected with the reservoir ink tank.

Figure 2:
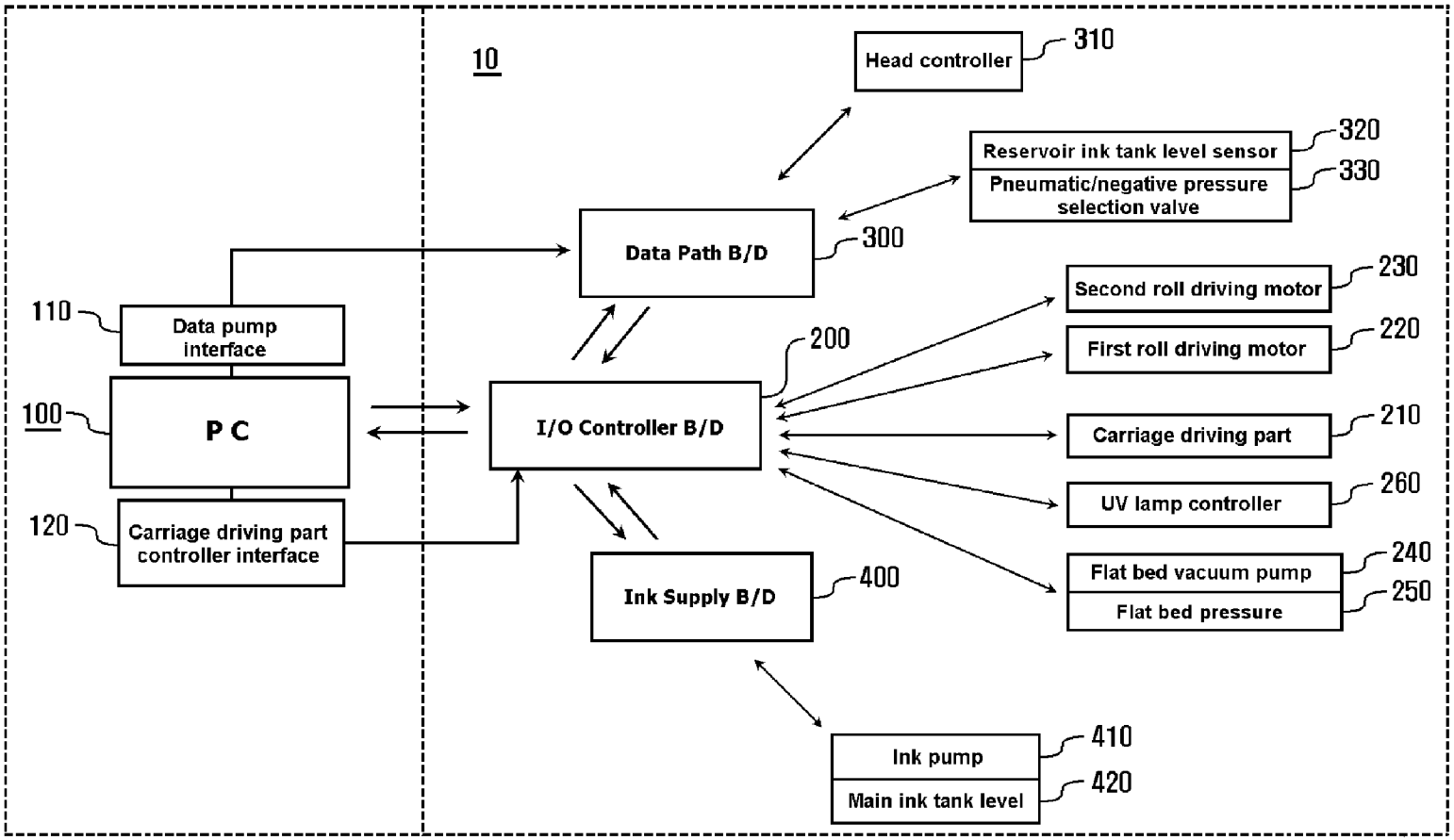
FIG. 2 is a view illustrating a communication relationship of a printing system formed of a large size ink jet printer and a PC of FIG. 1.

As shown in FIG. 2, the printing system 1 with a large size ink jet printer 10 of FIG. 1 comprises a personal computer (PC) 100 connected with a user input and output device (not shown), and a large size ink jet printer 100 for transmitting and receiving the data with the PC 100.

The user input and output device (not shown), as not shown in FIG. 2, is connected with the PC 100 for transmitting and receiving the data. For example, the user input and output device comprises a keyboard (not shown) for a user to input commands, and a monitor (not shown) for displaying the data received from the PC 100. It is obvious that the above disclosure is not limited thereto.

The PC 100 comprises a RIP (Raster Image Process) program for converting an image/text signal from the user input and output device into an image/text raster (bit map) image data for printing, and a carriage driving part control program for controlling the operation of a carriage driving part 210, which will be described later, of the large size ink jet printer 10.

The inner slot of the PC 100 is equipped with a data pump interface 110 for transferring a RIP processed image data by the PC 100 to a data path board 300, which will be described later, in large volume and at a high speed. Here, the data transferred to the data pump interface 110 is transferred to the head controller 310 which controls the printer head at the data pump interface 110.

At another inner slot of the PC 100 is installed a carriage driving part controller interface 120 for transferring a signal of the carriage driving part control program of the PC 100, namely, a control signal of the carriage driving part 210 which drives the carriage 30 of FIG. 1 with a printer head to an I/O controller board 200, which will be described later, of the large size ink jet printer 10. Here, the controls signal transferred from the I/O controller board 200 to the carriage driving part 210 is transferred from the I/O controller board 200 to the carriage driving part 210.

The carriage driving part controller interface 120 is connected with the I/O controller board 200 and communicates data with the same, and the I/O controller board 200 transfer the control signal of the carriage driving part 210 received from the carriage driving part controller interface 120 to the carriage driving part 210, thus obtaining an accurate driving control.

The PC 100 monitors the state of a printer head of the large size ink jet printer 10 because the head controller 310 controlling the printer head is connected with a data path board 300 and communicates data with the same, and the data path board 300 is connected with the I/O controller board 200 and communicates data with the same, and the I/O controller board 200 is connected with the PC 100 and communicates data with the same.

As shown in FIGS. 1 and 2, the large size ink jet printer 10 comprises a printer body 20, a flat bed 21, a carriage 30, an ink jet printer module 31, a printer head (not shown), a reservoir ink tank unit 32, a carriage guide 40, an I/O controller board 200, a carriage driving part 210 with a driving motor and a linear scale, a first roll (not shown), a first roll driving motor 220, a second roll (not shown), a second roll driving motor 230, a flat bed vacuum pump 240, a flat bed pressure sensor 250, a UV lamp (not shown), a UV lamp controller 260, a data path board 300, a head controller 310, a reservoir ink tank (not shown), a reservoir ink tank level sensor 320, a pneumatic and negative pressure selection valve 330, an ink supply control board 400, an ink pump 410, a main ink tank (not shown), and a main ink tank level sensor 420. It is obvious that the above disclose is just one example of the large size ink jet printer 10, not limiting thereto.

At least one main ink tank can be provided. For example, the main ink tank might be formed of four main ink tanks of C, M, Y and K and might further comprise a plurality of main ink tanks for a washing liquid, a primer solution, a coating solution, a white ink (base ink).

The ink of each main ink tank is supplied to the reservoir ink tank of the carriage 30*v* via the ink tank 410 installed at an upper side, respectively.

A main ink tank level sensor 420 is installed in the interior of each main ink tank for detecting the level of ink.

The ink supply control board 400 is connected with an I/O controller board and communicates data with the same, thus transmitting and receiving the data between the ink pump 410 and the main ink tank level sensor 420.

The ink supply control board 400 controls the ink pump 410 for the ink of the main ink tank to be transferred to the reservoir ink tank in accordance with a data from the reservoir ink tank level sensor 320 via the data path board 300 and the I/O controller board 200 while the valves of the supply line cooperate with the supply of the ink.

The main ink tank level sensor 410 is subjected to detecting the remaining amount of the ink of the main ink tank, and when the main ink tank is short of ink, an ink shortage signal is transmitted to the ink supply control board 400, and the ink shortage signal received at the ink supply control board 400 is transmitted to the PC 100 via the ink supply control board 400 and the I/O controller board 200. Here, the PC 100 transfers the above signal to the user input and output device so that the user is informed of the shortage of ink, so the user can confirm that the shortage of ink on the monitor of the user input and output device.

Here, the data path board 300 is directly connected with the data pump interface 110 of the PC 100, thus receiving the data of the PC 100 via the data pump interface 110. Since a lot of data is transferred at a high speed, the above direct connection is made possible without having a certain intermediate process.

The data path board 300 is connected with a head controller 310 controlling the printer head, a reservoir ink tank level sensor 320, a pneumatic/negative pressure selection valve 330, and an I/O controller board 200 and communicates data with the same, respectively.

The data path board 300 is equipped with a MCU (microcontroller unit).

With the above construction, the data path board 300 becomes possible to control both the operation of the pneumatic/negative pressure selection valve 330 and the ink introduction from the reservoir ink tank to the printer head.

The data path board 300 analyzes the RIP data transferred from the PC 100 via the data pump interface 110 and transfers the data on the printer head to the head controller 310, and the head controller 310, which has received the data, operates the head nozzle (not shown) and allows the ink to be discharged toward the printing object to be printed.

The reservoir ink tank level sensor 320 is connected with a data path board 300 and communicates data with the same.

The reservoir ink tank level sensor 320 transmits an ink shortage signal to the data path board 300 when the reservoir ink tank is short of ink by detecting the remaining amount of ink, and the signal received by the data path board 300 is transmitted to the ink supply control board 400 via the I/O controller board 200. At this time, the ink supply control board 400 controls the ink pump 410 for the ink of the main ink tank to be supplied to the reservoir ink tank based on the signal received from the data path board 300 via the I/O controller board 200. Valves are provided at the supply line and help supply the ink.

The pneumatic/negative pressure selection valve 330 is connected with the data path board 300 and communicates data with the same.

The pneumatic/negative pressure selection valve 330 is controlled by means of the data path board 300, and the pneumatic/negative selection valve 330 supplies the pneumatic positive pressure from the pneumatic pump (not shown) to the reservoir ink tank or comprises an ejector connected with the pneumatic pump for applying negative pressure at the reservoir ink tank. Here the negative pressure helps not allow the ink fall down in the direction of gravity.

The pneumatic/negative pressure selection valve 330 is controlled by means of the data path board 300 and might operate in cooperation with the printer head of the head controller 310 connected with the data path board 300.

The first roll driving motor 220 drives a first roll to transfer a printing object, and is connected with the I/O controller board 200 and communicates data with the same.

The second roll driving motor 230 drives a second roll so as to maintain a certain tension of the printing object of the first roll and communicates the data with the I/O controller board 200.

There is further provided a detection sensor for detecting the positions of the first roll and the second roll.

The carriage driving part 210 comprises a driving motor and a linear scale and might further comprise a sensor (not shown) for detecting errors in operation.

The carriage driving part 210 allows the carriage with the printer head to move along the axes of X, Y and Z. The carriage 30 might be driven by a servo motor, which is a driving motor for each axis. The sensor might be provided at an end of each axis.

The UV lamp controller 260 is connected and communicates the data with the I/O controller board 200, thus controlling the UV lamp so that the UV ink can be substantially hardened after printing.

The flat bed vacuum pump 240 is connected and communicates the data with the I/O controller board 200 and is controlled by means of the I/O controller board 200.

The flat bed vacuum pump 240 applies a vacuum pressure to the flat bed on which a printing object is placed, with suction holes being formed at the flat bed, which results in easily fixing flexible printing objects, the fixing of which is not easy, on the flat bed.

The flat bed pressure sensor 250 is connected and communicates the data with the I/O controller board 200 and is controlled by means of the I/O controller board 200.

The flat bed pressure sensor 250 is directed to detecting the vacuum pressure of the flat bed formed by the flat bed vacuum pump 240.

In details, the flat bed vacuum sensor 250 detects the vacuum pressure applied to the flat bed, and transfers the sensed data to the I/O controller board 200, and the I/O controller board 200 computes a proper value based on the received data, thus controlling the flat bed vacuum pump 240 based on the computed value and forming a proper level of pressure.

The I/O controller board 200 is connected with the PC 100, the data path board 300, the ink supply control board 400, the first roll driving motor 220, the second roll driving motor 230, the carriage driving part 210, the UV lamp controller 260, the flat bed vacuum pump 240 and the flat bed pressure sensor 250, respectively and communicates data with the same.

It is preferred that the I/O controller board 200, the data path board 300, and the ink supply control board 400 are connected in a parallel connection by using RS485 or others. RS485 is an advanced version of RS232 and RS422 is kind of serial communication protocol standard which supports a home network. In the present invention, RS422 is adapted to supplement the problems of RS232 which has a slow transmission speed and a short transmission distance. RS485 is good at implementing the present invention since all devices can transmit and receive data on the same line.

The I/O controller board 200 comprises a MCU (microcontroller unit).

The I/O controller board 200 is basically directed to controlling the flat bed vacuum sensor 250, the vacuum pump 240, and the UV lamp controller 260 for controlling the UV lamp.

The I/O controller board 200 transfers the control signal of the carriage driving part 210 received from the carriage driving part controller interface 120 to the carriage driving part 210, thus implementing an accurate driving control.

The I/O controller board 200 receives the data from the board or the interface which are connected for a communication of data and analyzes the received data, and transfers the data to a corresponding board or an interface as a result of the analysis.

According to the printing system 1 of the present invention, the operation of the printer head, the valve control of the reservoir ink tank and the control of the ink supply and the flat bed device are directly only at either the PC 100 or the large size ink jet printer 10, and the I/O controller board 200 is designed to operate only at a certain element, and is designed to collect only necessary information via the data path board 300 and the ink supply control board 400, which are provided separately, and analyzes the collected information and transfers a proper signal to the boards or transfers the current situation to the PC 100, so each board is assigned with a proper capacity of data process. Consequently, the present invention is characterized in that the data is not over applied to only one side among the large size ink jet printer 10 and others, thus achieving a fast and stable data transmission and operation as compared to the conventional printing system.

INDUSTRIAL APPLICABILITY

The present invention relates to a large size ink jet printer, and in particular to a printing system of a printer generally used in the industrial field.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A printing system comprising:

a computer device; and a large size ink jet printer transmitting and receiving a data with the computer device, wherein said computer device includes:

a RIP (Raster Image Process) program configured to convert an image/text signal into an image/text raster (bit map) image data for printing;

a data pump interface configured to transfer said image/text raster (bit map) image data into a data path board of the large size ink jet printer;

a carriage driving part control program controlling an operation of the carriage driving part of the large size ink jet printer; and a carriage driving part controller interface configured to transfer said signal of the carriage driving part control program into an I/O (Input and Output) controller board of the large size ink jet printer, and wherein said large size ink jet printer includes:

at least one main ink tank;

a level sensor configured to detect an ink level in said main ink tank;

at least one printer head configured to inject ink on a printing object which is to be printed;

a printer head controller configured to control the operation of said printer head;

at least one reservoir ink tank configured to supply ink into the printer head;

a reservoir ink tank level sensor configured to detect an ink level of said reservoir ink tank;

an ink pump supplying an ink from the main ink tank to the reservoir ink tank;

a pneumatic and negative pressure selection valve configured to selectively apply either a pneumatic or negative pressure to the reservoir ink tank;

the data path board equipped with a MCU configured to analyze said image/text raster (bitmap) image data received from the data pump interface by the MCU, transfer an analyzed control signal into the head controller, and based on the analyzed control signals, controls the operation of the pneumatic and negative pressure selection valve and transfers the signal of the reservoir ink tank sensor to the I/O controller board;

an ink supply control board configured to receive the ink level data of the reservoir ink tank from the I/O controller board, control the operation of the ink pump, and transfer the ink level data of the main tank to the I/O controller board;

a carriage with the printer head;

the carriage driving part configured to move the carriage in at least one direction; and the I/O controller board equipped with a MCU configured to analyze the data received from the computer device, the data path board and the ink supply control board, and to control the operation of the data path board, the ink supply board and the carriage driving part by the MCU of the I/O controller board.

2. The system of claim 1, wherein an ink injected from the printer head of the large size ink jet printer is a UV ink, and said large size ink jet printer further comprises:

a UV lamp configured to harden the UV ink; and a UV lamp controller connected with the I/O controller board configured to control the operation of the UV lamp by the data received from the I/O controller board.

3. The system of claim 1, wherein said large size ink jet printer further comprises:

a flat bed with suction holes configured to support a printing object;

a flat bed vacuum pump connected with the I/O controller board and configured to apply a vacuum pressure to the flat bed by the data received from the I/O controller board;

a flat bed pressure sensor connected with the I/O controller board and configured to detect a vacuum pneumatic pressure of the flat bed by the data received from the I/O controller board.

4. The system of claim 1, wherein said large size ink jet printer further comprises:

a first roll configured to transfer a printing object in the course of printing; and a first roll driving motor connected with the I/O controller board and configured to drive the first roll by the data received from the I/O controller board.

5. The system of claim 4, wherein said large size ink jet printer further comprises:

a second roll configured to maintain a certain tension of a printing object of the first roll; and a second roll driving motor connected with the I/O controller board and configured to drive the second roll by the data received from the I/O controller board.

* * * * *